US005238436A

United States Patent [19]

Lee et al.

[11] Patent Number: 5,238,436

[45] Date of Patent: Aug. 24, 1993

[54] LAMP AIR EXHAUSTING APPARATUS

[75] Inventors: Kye S. Lee, Suweon; Duk S. Park, Hwasung, both of Rep. of Korea

[73] Assignee: Samsung Electron Devices Co., Ltd., Kyungki, Rep. of Korea

[21] Appl. No.: 843,815

[22] Filed: Feb. 28, 1992

[30] Foreign Application Priority Data

Jun. 14, 1991 [KR] Rep. of Korea ..... 91-9785

[51] Int. Cl.[5] ..... H01J 9/385

[52] U.S. Cl. ..... 445/29; 445/38; 445/67; 445/73

[58] Field of Search ..... 445/38, 67, 69, 73, 445/29, 53

[56] References Cited

U.S. PATENT DOCUMENTS

| | | | |
|---|---|---|---|
| 1,751,419 | 3/1930 | Phelps | 445/67 |
| 2,554,013 | 5/1951 | Cooper et al. | 445/69 |
| 3,008,035 | 11/1961 | Smith | 445/69 |
| 4,647,277 | 3/1987 | Shiraishi | 445/67 |

*Primary Examiner*—Kurt C. Rowan
*Assistant Examiner*—Jeffrey T. Knapp
*Attorney, Agent, or Firm*—Ladas & Parry

[57] ABSTRACT

A lamp air exhausting apparatus is disclosed, which comprises a compression head, a holding assembly, and a securing member. The holding assembly comprises a holder, a flexible tube, a push rod, an eccentric cam and a spring. According to the present invention, a separate exhausting tube is not required, and an electrode can be accurately placed at the center of the lamp.

17 Claims, 1 Drawing Sheet

LAMP AIR EXHAUSTING APPARATUS

FIELD OF THE INVENTION

The present invention relates to a lamp air exhausting apparatus for sealing off the lamp after exhausting the air from the interior of the lamp in order to maintain the interior of the lamp in a vacuum.

BACKGROUND OF THE INVENTION

Generally, as shown in FIG. 1, a conventional lamp air exhausting apparatus comprises a compression head 1 including a head 6 connected to a vacuum system (not shown), a cap 2 engaged with the head 6, and a rubber ring 3 disposed between the head 6 and the cap 2. Further, an exhausting tube 4*a* is formed at the end of a lamp 4, and, if the exhausting tube 4*a* is fitted to the head 1, and if the cap 2 is turned, a push portion 5 secured to the lower portion of the cap 2 will press against the rubber ring 3, so that a seal is formed between the lamp 4 and the head 6 so that when head 6 is subjected to the vacuum, the air in the lamp will be exhausted.

However, the lamp 4 is provided with an electrode 7 at the center of the end of the lamp 4, and a lead 7*a* of the electrode 7 is secured to the lower portion of the lamp 4 in a state with the electrode 7 installed at the center of the tip of the lamp 4. Consequently, the exhausting tube 4*a* had to be separately provided for carrying out the air exhaust.

As a result, it is not an easy task to install the electrode when forming the lamp, as well as in locating the center. Further, the provision of the separate exhausting tube causes complication of the manufacturing process, thereby lowering the productivity.

SUMMARY OF THE INVENTION

An object of the present invention is to provide a lamp air exhausting apparatus in which an electrode is not formed during the formation of the lamp, but is installed during the sealing and air exhausting process, thereby making a separate exhausting tube unnecessary, and making it possible to install the electrode at the center of the lamp accurately.

In achieving the above object, the lamp air exhausting apparatus for sealing the lamp after exhausting the air, according to the present invention, comprises a compression head connected to a vacuum system for exhausting the air from the interior of the lamp, a holding means for holding the lead of an electrode so as to put the electrode at the center of the lamp, and a securing member for securing the holding means on a side of the compression head.

DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
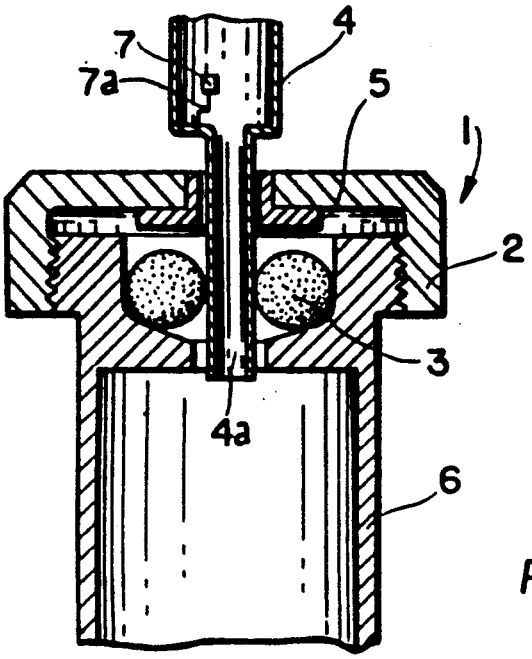
FIG. 1 PRIOR ART
FIG. 1 is a sectional-view showing the conventional air exhausting apparatus.
Figure 2:
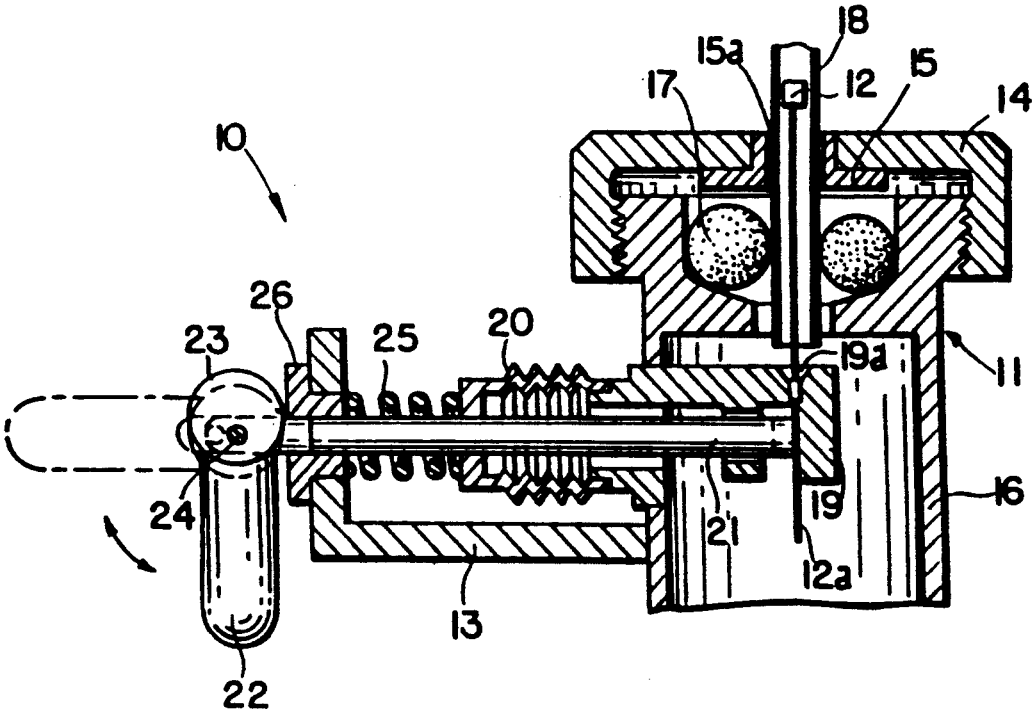
FIG. 2 is a sectional-view showing the air exhausting apparatus according to the present invention.

FIG. 2 shows a lamp air exhausting apparatus, according to the present invention, wherein a holding means 10 for holding a lead 12*a* of an electrode 12 is installed by a securing member 13 to a side of an ordinary compression head 11 connected to a vacuum system (not shown).

The compression head 11 is connected to a vacuum system (not shown) as described above, and a cap 14 is threadably engaged with the end portion of a head 16. A push portion 15 with an insertion slot 15*a* formed thereon is secured to the center of the cap 14, and a rubber ring 17 is disposed between the push portion 15 and the head 16.

The holding means 10 which is secured to the side of the compression head 11 by the securing member 13 is constituted such that a holder 19 for guiding the lead 12*a* of the electrode 12 extends into the interior of the head 16, so that the electrode 12 can be installed exactly at the center of the lamp 18 which is inserted into the compression head 11. Further, a flexible tube 20 is welded to the holder 19 (exposed at the outside of the head 16), so that the air tight state should be maintained. There is installed a push rod 21 for holding the lead 12*a* of the electrode 12 which is inserted through a guide hole 19*a* of the holder 19, and the push rod 21 is welded where it contacts the flexible tube 20.

Also, an eccentric cam 23 with a knob 22 formed thereon which together comprise a movable means for moving the push rod, is rotatably secured to an end of the push rod 21 by means of a pin 24, and a spring 25 is installed in a compressed state between the securing member 13 and the flexible tube 20 in order to bear elastically against the flexible tube 20, while a bush 26 is installed between the securing member 13 and the eccentric cam 23 in order to prevent the wear of the eccentric cam 23.

In the apparatus as described above, a separate air exhausting tube is not required. That is, one end of the lead 12*a* of the electrode 12 is installed in the lamp 18 is inserted through the insertion slot 15*a* of the compression head 11, while with the knob 22 in the position shown in the chain-dotted outline, the other end of the lead 12*a* is guided through the guide hole 19*a* of the holder 19. Then, if the knob 22 of the holding means is turned from its position shown in chain-dotted outline to the position shown in solid lines in the drawing, the eccentric cam 23 with the knob integrally formed thereon and the push rod 21 connected by the pin 24 are moved to the right by the amount of the eccentricity of the eccentric cam 23 in response to the rotation of the eccentric cam 23. Consequently, the push rod 21 and the flexible tube 20 with its contact portion welded are pushed to the right in FIG. 2. Consequently, the push rod 21 presses against the lead 12*a* of the electrode 12 which is guided through the guide hole 19*a* of the holder 19 with the help of the reaction force of the spring which had been compressed between the securing member 13 and the flexible tube 20, thereby securing the electrode 12 in its position.

Thus, the electrode 12 is secured in the compression head 11 by the holding means, and therefore, if the lamp 18 is inserted into the inserting hole 15*a* of the compression head 11, the electrode 12 is positioned at the center of the lamp 18. Then, if the cap 14 is turned lower the push portion 15 to press against the rubber ring 17, the rubber ring 17 securely holds the lamp 18, and, at the same time, the air-tight state between the head 16 and the lamp 18 is produce, so that the air exhausting can be carried outer. Thus, if the lamp 18 is directly sealed off after the air exhaust, the electrode 12 is secured to the center of the lamp 18 upon sealing the lamp 18.

After the completion of the air exhaust and the sealing, if the knob 22 is moved from the solid line position to the chain dotted line, position the push rod 21 is restored to the original position by being moved to the left owing to the eccentric cam 23, and the flexible tube 20 which is secured to the push rod 21 at the contact point is extended again, while the spring 25 is compressed to its original state.

According to the present invention as described above, holding means 10 which is capable of securing the electrode at the center of the lamp all the time is installed at the side of the compression head adapted for carrying out the air exhaust. Therefore, the electrode can be easily installed in the lamp, and the electrode can be kept at the center of the lamp all the time, with the result that the requirement for the installation of a separate exhausting tube is eliminated, thereby simplifying the air exhaust and sealing process and improving the productivity.

What is claimed is:

1. A lamp air exhausting apparatus for sealing a lamp after exhausting air from the interior of said lamp in order to maintain the interior of said lamp in a vacuum, said apparatus comprising:

a compression head having a hole in which an open end of a lamp can be inserted, said compression head being connected to a vacuum system so as to exhaust the air from the interior of said lamp;

a holding means for holding a lead of an electrode so that the lead of the electrode passes through the open end of the lamp and said electrode is disposed at the center of said lamp;

securing means for securing said holding means so that the holding means extends laterally at one side of said compression head; and said holding means comprising a movable member having a first position in which said lead can be inserted into said holding means and a second position in which said lead is clamped and held in said holding means.

2. The lamp air exhausting apparatus as claimed in claim 1, wherein said holding means comprises:

a holder with a guide hole formed therein to receive said lead of said electrode;

a flexible tube secured to one side of said holder;

a push rod welded to said flexible tube for displacement to clamp said lead of said electrode in said holder;

said movable member comprising an eccentric cam connected to said push rod, and including an integral knob for moving said push rod to the left and right as the cam is rotated; and a spring for providing an elastic force during the movements of said push rod.

3. A lamp air exhausting apparatus as claimed in claim 2, wherein said push rod is movable between two positions, in the first of which the lead of the electrode can be inserted into the guide hole of the holder, and in the second of which the lead of the electrode is in clamped position for insertion into said lamp when the open end of the lamp is inserted into the hole in the compression head.

4. Apparatus for securing a lead and electrode in a vacuum lamp comprising:

a compression head having an opening to receive a lamp into which an electrode on an electrode lead is to be inserted and the lamp exhausted, said compression head being connectable to a vacuum source;

holding means connected to said head for receiving and holding the electrode lead which is inserted into said head through said opening before the lamp is connected into said opening;

means accessible from outside said compression head for operating said holding means to clamp the electrode lead in a position in which when the lamp is placed in said opening, said electrode and said electrode lead will be centered in said lamp; and resilient means in said head for resiliently engaging said lamp to hold the same secure in said opening and seal the lamp from ambient atmosphere.

5. Apparatus as claimed in claim 4, comprising spring means acting in said holding means for clamping the electrode lead in to said position in which the electrode lead is centered with respect to said lamp.

6. Apparatus as claimed in claim 5, said holding means comprising a holder receiving and holding said electrode lead a displaceable push rod in said holder, said means for operating said holding means comprising handle means connected to said push rod to displace the same between an initial position to receive the electrode lead and said position in which the electrode lead is clamped and centered with respect to said lamp.

7. Apparatus as claimed in claim 6, comprising a securing member supporting said push rod, said handle means comprising an eccentric cam rotatably connected to said push rod and bearing against said securing member.

8. Apparatus as claimed in claim 7, comprising means including a flexible member fixed to said push rod and said compression head, and a compression spring acting between said securing member and said means which includes the flexible member.

9. Apparatus as claimed in claim 8, wherein said securing member and said means including the flexible member extends laterally at one side of said compression head.

10. Apparatus as claimed in claim 9, wherein said means including the flexible member comprises a tubular member surrounding said push rod.

11. A method of inserting an electrode lead and an electrode into a lamp and evacuating the lamp comprising:

inserting an electrode lead through a hole in a compression head into a holder;

holder the electrode lead in said holder with an electrode on said lead;

displacing a push rod in said holder to clamp the electrode lead laterally in a determined position relative to said hole;

inserting a lamp to be evacuated and sealed into said hole while said lamp receives said electrode and said electrode lead centrally therein due to said determined position of the holder relative to said hole;

sealing said lamp in said compression head; and evacuating said lamp by applying vacuum to said compression head.

12. A method as claimed in claim 11, wherein said displacing of said push rod in said holder to clamp said electrode lead in said determined position is effected by applying force of a spring to said push rod.

13. A method as claimed in claim 12, comprising compressing said spring when said push rod in said holder is in an initial position to receive said electrode lead.

14. A method as claimed in claim 12, comprising effecting said displacing of said push rod in said holder by turning a knob to rotate an eccentric cam.

15. A method as claimed in claim 11, comprising sealingly connecting said holder to said compression head.

16. The lamp air exhausting apparatus as claimed in claim 1, wherein said holding means is sealably connected to said compression head.

17. Apparatus as claimed in claim 4, wherein said holding means is sealably connected to said compression head.

* * * * *